US009082304B2

(12) United States Patent
Benn

(10) Patent No.: US 9,082,304 B2
(45) Date of Patent: Jul. 14, 2015

(54) ENHANCED BARREL MOUNTED TRAFFIC MESSAGE BOARD SYSTEMS AND METHODS

(71) Applicant: Llewellyn Richard Benn, Brooklyn, NY (US)

(72) Inventor: Llewellyn Richard Benn, Brooklyn, NY (US)

( * ) Notice: Subject to any disclaimer, the term of this patent is extended or adjusted under 35 U.S.C. 154(b) by 0 days.

(21) Appl. No.: 13/894,371

(22) Filed: May 14, 2013

(65) Prior Publication Data

US 2013/0314255 A1 Nov. 28, 2013

Related U.S. Application Data

(60) Provisional application No. 61/646,499, filed on May 14, 2012.

(51) Int. Cl.

| | |
|---|---|
| ***G08G 1/095*** | (2006.01) |
| ***G08G 1/0955*** | (2006.01) |
| ***E01F 9/011*** | (2006.01) |
| ***E01F 9/012*** | (2006.01) |

(52) U.S. Cl.

CPC ..... *G08G 1/0955* (2013.01); *E01F 9/0118* (2013.01); *E01F 9/0122* (2013.01); *E01F 9/0124* (2013.01)

(58) Field of Classification Search

CPC ..... E01F 9/0124; E01F 9/011; E01F 9/014; E01F 15/083; G08B 5/006; G08B 1/0955; G08B 1/096791; F21V 23/023; F21W 2111/02; G09F 13/04; G09F 15/0037; G09F 7/18; G09F 27/00; G09F 7/20

USPC ..... 340/907, 908.1, 908, 471, 473; 362/145, 157, 362, 368, 551, 576; 404/9

See application file for complete search history.

(56) References Cited

U.S. PATENT DOCUMENTS

| | | | | |
|---|---|---|---|---|
| 2,838,744 | A | 6/1958 | De Wald et al. | |
| 4,298,869 | A | 11/1981 | Okuno | |
| 5,097,612 | A | 3/1992 | Williams | |
| 5,613,798 | A | 3/1997 | Braverman | |
| 5,630,675 | A | 5/1997 | Boeger | |
| 5,715,619 | A | 2/1998 | Polisois et al. | |
| 5,769,027 | A | 6/1998 | Adams et al. | |
| 5,868,520 | A | 2/1999 | Kulp et al. | |
| 5,986,576 | A * | 11/1999 | Armstrong | 340/908 |
| 6,071,037 | A | 6/2000 | Holt | |
| 6,693,556 | B1 | 2/2004 | Jones et al. | |
| 6,769,207 | B1 * | 8/2004 | Brown et al. | 40/607.12 |
| 6,948,446 | B2 | 9/2005 | Greves | |

(Continued)

OTHER PUBLICATIONS

International Search Report and Written Opinion issued in related PCT Patent Application Serial No. PCT/US08/75147, dated Nov. 19, 2008, 11 pages.

(Continued)

*Primary Examiner* — George Bugg
*Assistant Examiner* — Edny Labbees
(74) *Attorney, Agent, or Firm* — Lathrop & Gage LLP

(57) ABSTRACT

Systems and methods disclose an enhanced barrel mounted traffic message board system for displaying information to traffic. A traffic message board is adjustably coupled to a pole and configured to display the traffic information to the traffic. A battery provides power to the traffic message board and a solar panel provides power to the battery. A traffic barrel is positioned around the pole and over a base plate that supports the pole. An internal structure positioned within the barrel couples with the base plate to provide support to the pole.

6 Claims, 8 Drawing Sheets

(56) References Cited

U.S. PATENT DOCUMENTS

| | | | | |
|---|---|---|---|---|
| 7,048,400 | B2 | 5/2006 | Murasko et al. | |
| 7,156,576 | B1 * | 1/2007 | Kulp et al. | 404/6 |
| 7,230,546 | B1 | 6/2007 | Nelson et al. | |
| 7,233,259 | B2 * | 6/2007 | Gibson et al. | 340/907 |
| 7,694,431 | B2 * | 4/2010 | Tang | 33/772 |
| 8,157,405 | B1 * | 4/2012 | Schlanger et al. | 362/183 |
| 2001/0028227 | A1 | 10/2001 | Lys et al. | |
| 2002/0005826 | A1 | 1/2002 | Pederson | |
| 2002/0175831 | A1 | 11/2002 | Bergan et al. | |
| 2003/0169164 | A1 | 9/2003 | Lau | |
| 2003/0213152 | A1 | 11/2003 | Kim | |
| 2004/0151543 | A1 * | 8/2004 | Mettler et al. | 404/9 |
| 2005/0007304 | A1 | 1/2005 | Gallagher et al. | |
| 2005/0046595 | A1 | 3/2005 | Blyth | |
| 2005/0072350 | A1 | 4/2005 | Aasgaard | |
| 2005/0231459 | A1 | 10/2005 | Furukawa | |
| 2006/0012486 | A1 | 1/2006 | Gibson et al. | |
| 2008/0129543 | A1 * | 6/2008 | Lee | 340/908 |
| 2008/0136671 | A1 | 6/2008 | Shen | |
| 2009/0058680 | A1 * | 3/2009 | Benn | 340/908.1 |
| 2013/0248673 | A1 * | 9/2013 | Townsend, Jr. | 248/327 |

OTHER PUBLICATIONS

Solar Technology, Inc. "The Silent Sentinel—Solar Powered Advance Warning Arrow Panels" Models AB-0515 & AB 0715 and AB-0525 and AB-0725, 2 pages, Sep. 15, 2004.

* cited by examiner

The Company

TrafficSAMS™, LLC (TrafficSAMS™ or the Company) is a newly-formed Delaware corporation which is focusing on the commercialization of its founder's design for an innovative, programmable and environmentally-friendly Traffic Safety Arrow Messaging System (the TrafficSAMS™ product). The Company is located in Brooklyn, New York.

Product and Service Offerings

TrafficSAMS™ provides a unique traffic messaging arrow system. It is substantially smaller and more portable than current temporary sign systems, especially in the hardware necessary to support the visual display and to power the unit.

The system is very lightweight and can be anchored in many places by various ballast pieces, depending on the location and application of the unit. The sign section of the unit is LED display which is very bright, fully-programmable, and energy efficient. As an option, the unit's sign message can be programmed remote via wireless connection from a PC or remote control.

Why TrafficSAMS

- First truly compact messaging system
- Provide extra safety around job sites
- Can be mounted on existing construction barrels, barriers, guardrails and tripods
- Cost 50-80% less than trailer or truck mounted units
- Durable
- Low maintenance
- Remote control handset so that the operator does not have to leave his vehicle to adjust settings
- Solar power, rechargeable batteries and equipped with an AC/DC option as an alternative power source

Customers

- Contractors on road and bridge construction
- Police departments
- Emergency services
- Crowd control
- Government agencies
- Commercial advertising A solar panel array sits on top of the skis unit to provide charging of the battery bank during daylight hours. The LED message board contains a matrix of LEDs coated and protected to withstand outdoor elements. The board has the ability to display 10" to 18" letters depending on the model.

To maintain legibility, the sign is design to automatically adjust to the brightness under varying light conditions (like bright sunny day).

SAMPLE MESSAGES:

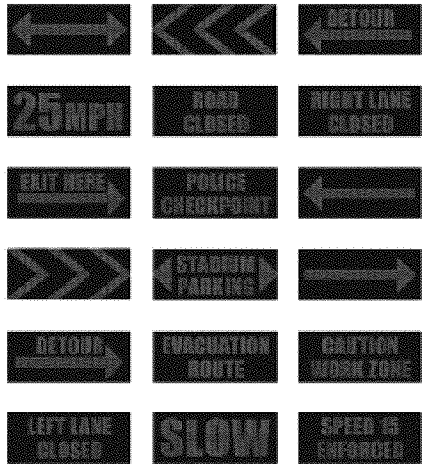

And Many More...

Traffic SAMS Uses:

On Any Construction Site
At Railway Crossings
On Road Construction Areas
At School Crossings
By Utility Companies
At Sports Arenas
At Concerts & Special Events
By Parks & Recreation Depts.
Etc., Etc., Etc....

Approved by:
U.S. Department of Transportation
Federal Highway Administration

In compliance with MUTCD Section 6F.60 and qualifies under category IV

*FIG. 6*

600 traffic SAMS™

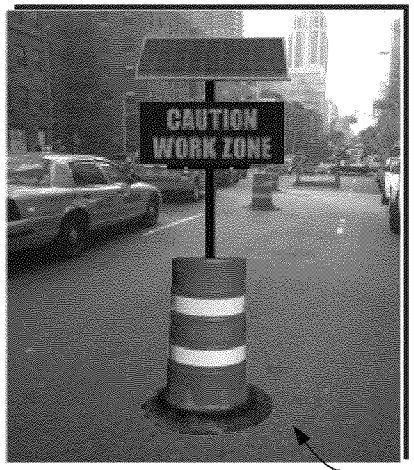

TRAFFIC SAMS MODEL TSS1

100

Contact:
Joél Contreras at 303-596-7717
or
email: jc@trafficsams.com
trafficsams.com

Portable, Cost Effective, Remote Controlled & "Green." Made in the USA!

Top 10 Benefits Of Using Our Patent Pending Traffic Safety Arrow Messaging System!

1. Solar Powered "Green Technology
We've designed, engineered and manufactured Traffic SAMS to be a 100% "green technology" with multi-day power capacity and no need for any sunlight for a minimum of 3 days. In addition, your purchase may qualify for government "Green Incentive programs."

2. Portable & Durable
Whether setting up on a construction site, on the street or highway, or for emergency management purposes, our Traffic SAMS is engineered for quick, easy, and reliable installation.

3. Construction Safety Barrel or Tripod Mount
Our Traffic SAMS devices can be mounted on either Construction Safety Barrels or on our specialized tripod mounting units.

4. Cost Effective
Our devices cost an average of 50-80% less than trailer or truck mounted units and with many more features and benefits than these other competing products.

5. Equipped with Anti-Theft Tracking Technology
Whether you decide to leave your Traffic SAMS device on the job site for hours or multiple days, you can rest assure that your investment is secured from theft. That's because we've engineered an anti-theft tracking device in each and every one of our Traffic Safety Arrow Messaging Systems devices.

6. Controlled Remotely
With our devices, there is no need to physically be in front of the unit to add and or modify safety messages. This remote control feature ensures the safety of workers responsible for managing the messages on each device.

7. Can be Used Below Ground
Unlike most other competing devices, our Traffic SAMS unit can be used for messaging below ground.

8. Equipped with AC/DC Below Ground
Each of our Traffic SAMS devices come equipped with an AC/DC option as an alternative power source. This allows you to utilize our devices not only above ground, but also below for an extended period of time.

9. Five (5) Year Warranty
We offer a 5-year warranty on every single device sold.

10. Made in the USA
Last but not least, our Traffic Safety Arrow Messaging Systems devices are manufactured in the good 'ole US of A, So you can feel confident that your investment is helping our nation.

Approved by:

U.S. Department of Transportation

Federal Highway Administration traffic SAMS

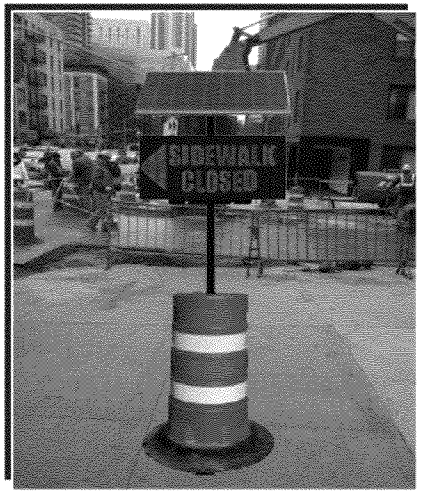

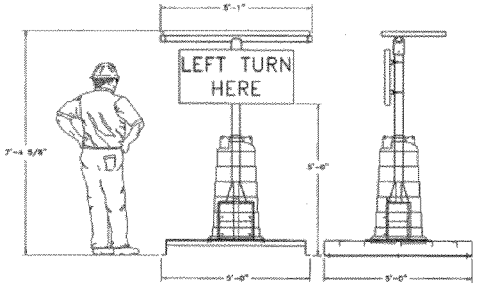

Traffic SAMS MODEL TSS1

*FIG. 7*

700

| TrafficSAMS Specifications | |
|---|---|
| **Active viewable area (feet)** | |
| Height: | 1.75 feet |
| Width: | 3.84 feet |
| Square Footage per Face: | 6.72 squared feet |
| **Physical cabinet** | |
| Aluminum cabinet | Steel Cabinet, Painted |
| Weather proof panels | yes |
| **Weight** | |
| Est. Weight: | 40 lbs |
| **LED's** | |
| Number of pixels: | 966 |
| Sign Resolution | 16mm |
| **Operating Specifications** | |
| Color Processing | Monochrome Amber |
| Brightness: | 4818 nits (all LEDs on) |
| Temp Probes: | None standard |
| Control Software: | Wireless programming full size keyboard |
| Sign Capabilities: | 7", 12", 14" fonts, 3 different messages, graphics like arrows, flashing, scrolling |
| Viewing Angle: | 30 degrees or 70 x 40 (Horizontal x Vertical) degrees upon customer request |
| Display Dimming: | 3 stages (full, medium, low) |
| Graphics Capacity | Arrows and custom graphics upon customer request |
| Video Formats | None |
| Software | No software needed |
| Communication | Wireless or RS-232 |
| **Electrical Specifications** | |
| Input Power: | 12 Vdc, 3.5 amps |
| Watts Per Pixel: | 11.2 milliWatt |
| Wattage Per Face: | 10.8 Watt (normal operation) |
| Max Load per Face: | 36 watts (when all LEDs are turned ON) |
| Typical Load per Face: | 10.8 Watt (normal operation) |
| Voltage | 8Vdc to 16Vdc |
| **Tripod Specifications** | |
| Collapsible, adjustable height tripod stand support with bolt on polycarbonate electronics enclosure. Stand is black, painted steel with Zinc Hardware. | |
| **Solar panel Specifications** | |
| Options from 50W to 270. 25 Yr. Limited Warranty. Polycrystalline, High Efficiency Cells. Aluminum, Anodized Frames. | |

ENHANCED BARREL MOUNTED TRAFFIC MESSAGE BOARD SYSTEMS AND METHODS

RELATED APPLICATIONS

This application claims priority to U.S. Provisional Patent Application Ser. No. 61/646,499, titled "Barrel Mounted traffic Message Board", filed May 14, 2012, and incorporated herein by reference.

BACKGROUND

Conventional traffic message boards are mounted and transported on trailers or on the rear of trucks. Such displays are typically large and heavy and are not convenient for rapid deployment or for use in areas of restricted size. For example, where construction is done within a narrow street, a conventional trailer or truck based traffic message board cannot be positioned in an optimal position without blocking the traffic.

In a prior co-owned invention (U.S. patent application Ser. No. 12/203,820), a traffic message board mounted directly to a traffic barrel is discussed. However, the design provided no flexibility in mounting height of the traffic message board, and provided inadequate structural integrity for the intended use of the barrel mounted traffic message board.

SUMMARY OF THE INVENTION

The embodiments shown and described herein provide substantial and novel improvement over the traffic message board mounted directly to the traffic barrel. That is, the embodiments herein may include all features described in U.S. patent application Ser. No. 12/203,820 and may include additional features that enhance the state of the art over the previous disclosure. For example, the added novel internal structure of the enhanced barrel mounted traffic message board system provides substantially more support for the traffic message board, flexibility in mounting height of the traffic message board display, and added safety in the event of a vehicle colliding with the enhanced barrel mounted traffic message board system.

In one embodiment, an enhanced barrel mounted traffic message board system displays information to traffic. The system includes a pole, a traffic message board adjustably coupled to the pole and configured to display the traffic information to the traffic, a battery for providing power to the traffic message board, a solar panel for providing power to the battery, a traffic barrel, a base plate, and an internal structure positioned within the barrel and coupled to the base plate to provide support to the pole.

In another embodiment, an enhanced Jersey barrier mounted traffic message board system displays information to traffic. The system includes a pole, a traffic message board for displaying the information to the traffic, wherein the traffic message board is adjustably coupled to the pole, a battery for providing power to the traffic message board, a solar panel for providing power to the battery, and a bracket for coupling the pole to the Jersey barrier.

In another embodiment, a method displays traffic information. A pole is attached to a base plate such that the pole is substantially vertical. A traffic message board is attached to the pole and displays the traffic information. A solar panel is attached to the top of the pole, and a traffic barrel is positioned around the pole and over the base plate.

BRIEF DESCRIPTION OF THE FIGURES

FIGS. 6 and 7 show a brochure for an exemplary enhanced barrel mounted traffic message board system, in an embodiment.

DETAILED DESCRIPTION OF THE EMBODIMENTS

Figure 1:
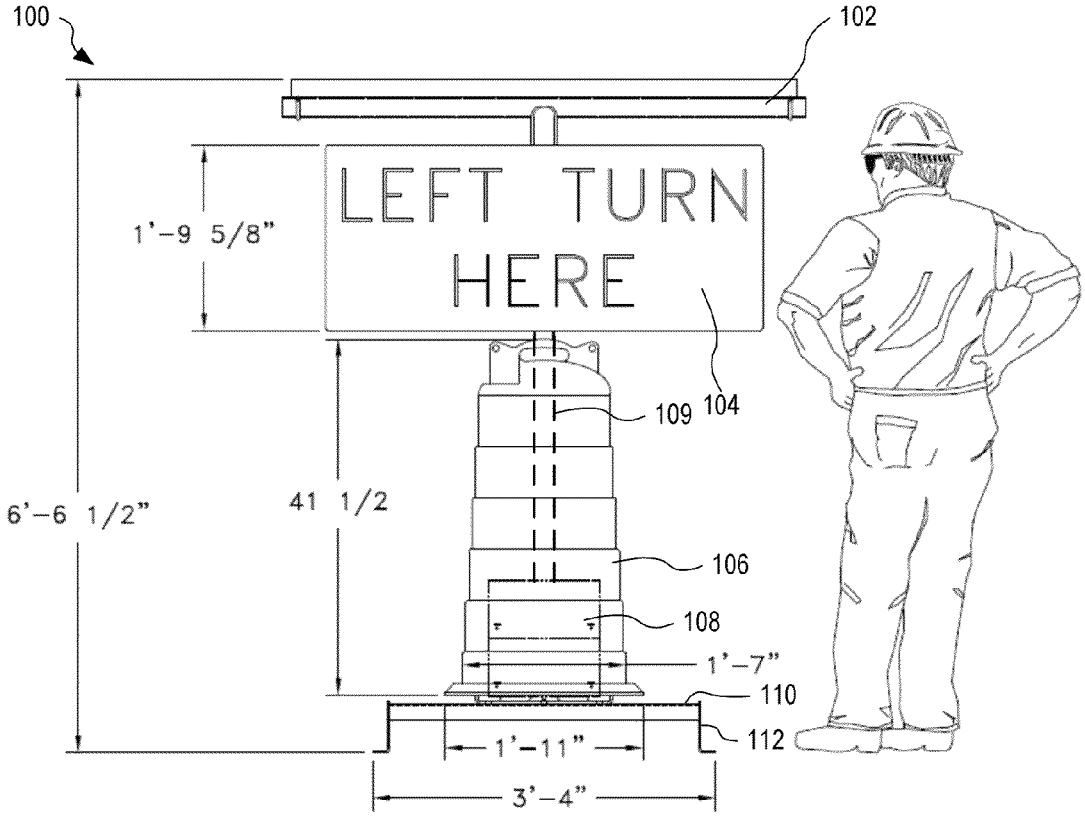
FIG. 1 shows a front view of one exemplary enhanced barrel mounted traffic message board system, in an embodiment.
Figure 2:
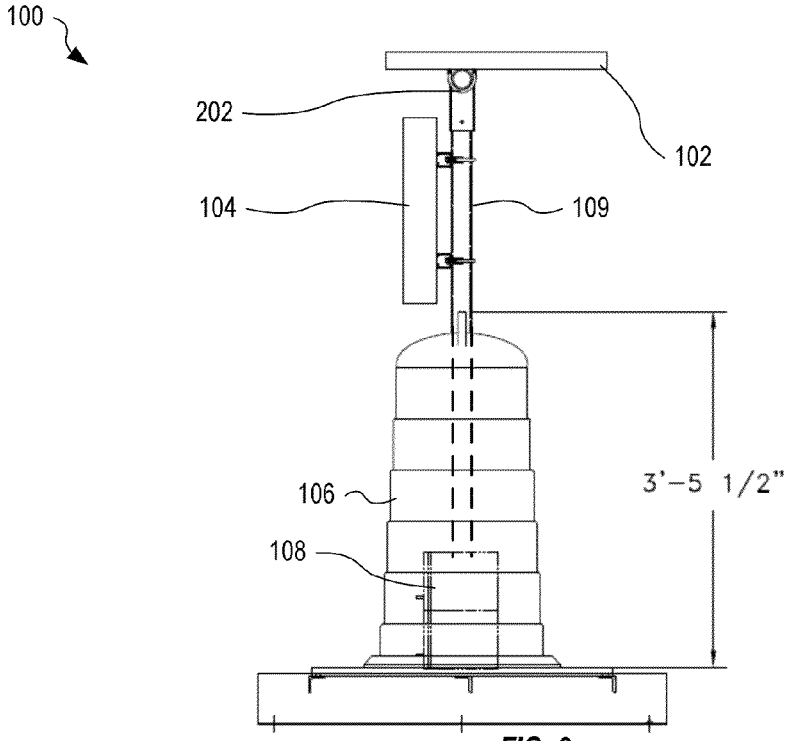
FIG. 2 is a side view of the enhanced barrel mounted traffic message board system of FIG. 1.

FIG. 1 shows a front view of one exemplary enhanced barrel mounted traffic message board system 100. Enhanced barrel mounted traffic message board system 100 has a solar panel 102, a message board 104, a pole 109, and a traffic barrel 106 that has an internal support structure 108 that may allow barrel mounted traffic message board system 100 to conform to department of transport collision requirements. FIG. 2 is a side view of barrel mounted traffic message board system 100 of FIG. 1, showing a hinged/swivel mount 202 of solar panel 102 that attaches to pole 109 to provide optimal orientation or solar panel 102. FIGS. 1 and 2 are best viewed together with the following description.

Internal support structure 108 attaches to pole 109 that extends through the top of barrel 106 and to which message board 104 and solar panel 102 attach. Pole 109 thereby provides height adjustment to one or both of message board 104 and solar panel 102. Internal support structure 108 may provide ballast that prevents enhanced barrel mounted traffic message board system 100 from becoming unstable and tipping over in strong wind or when accidentally struck by a vehicle. Optionally, internal structure 108 may house a battery (see FIGS. 8 and 9) that is used to power message board 104 and that receives power from solar panel 102.

In one embodiment, internal structure 108 is supported by, and optionally attaches to, a base plate 110 that may be attached to a rim 112 such that base plate 110 and rim 112 provide a base for enhanced barrel mounted traffic message board 100. Internal structure 108 attaches to and supports pole 109. Barrel 106 provides a cover for internal structure 108 and enhances recognition of enhanced barrel mounted traffic message board system 100 by vehicle drivers. Advantageously, the enhanced barrel mounted traffic message board systems 100 are portable and do not require a trailer mount, since they may weigh 150 lbs or less.

Figure 3:
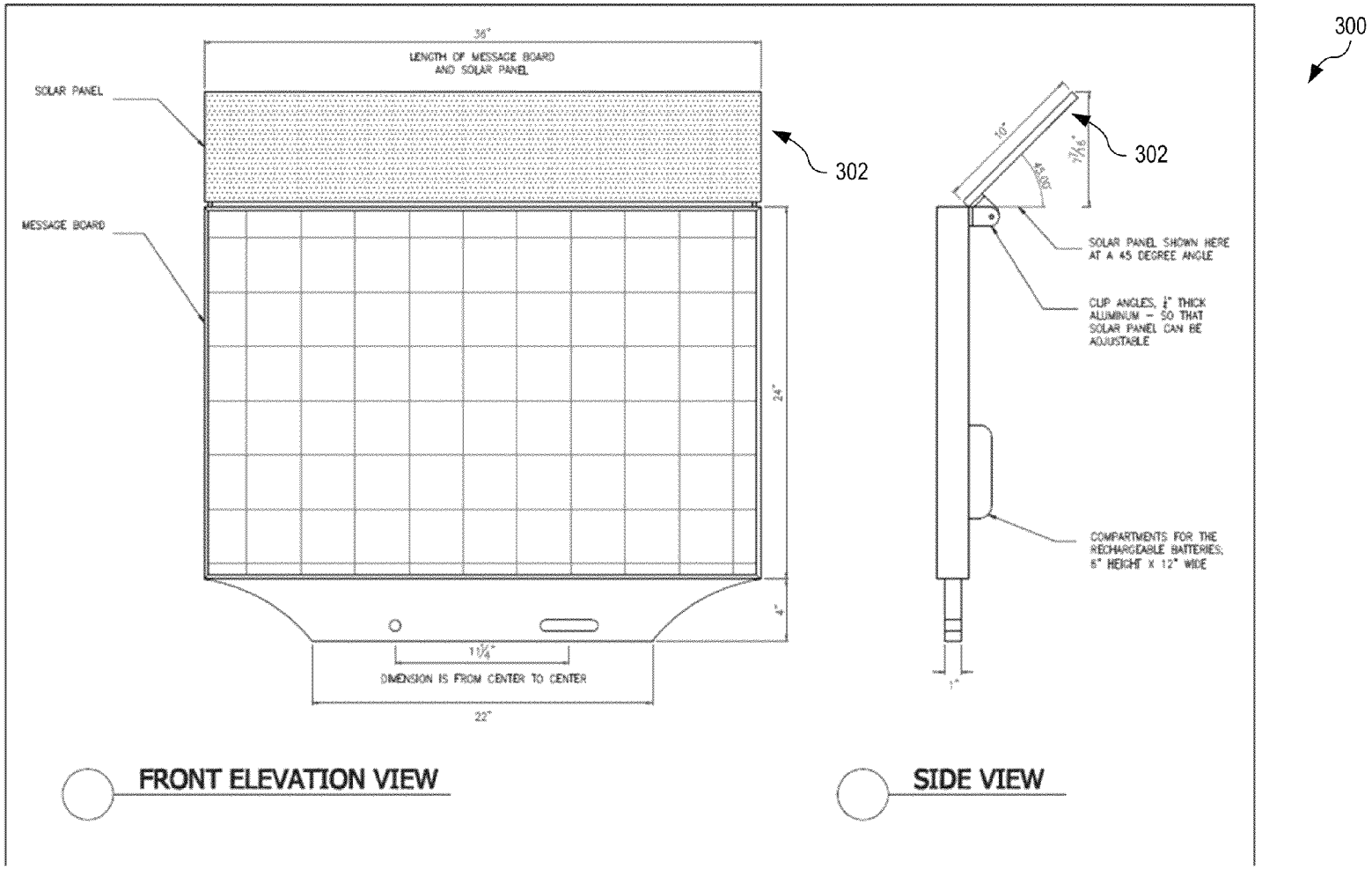
FIG. 3 is front elevation of an enhanced barrel mounted traffic message board system, in an embodiment.
Figure 4:
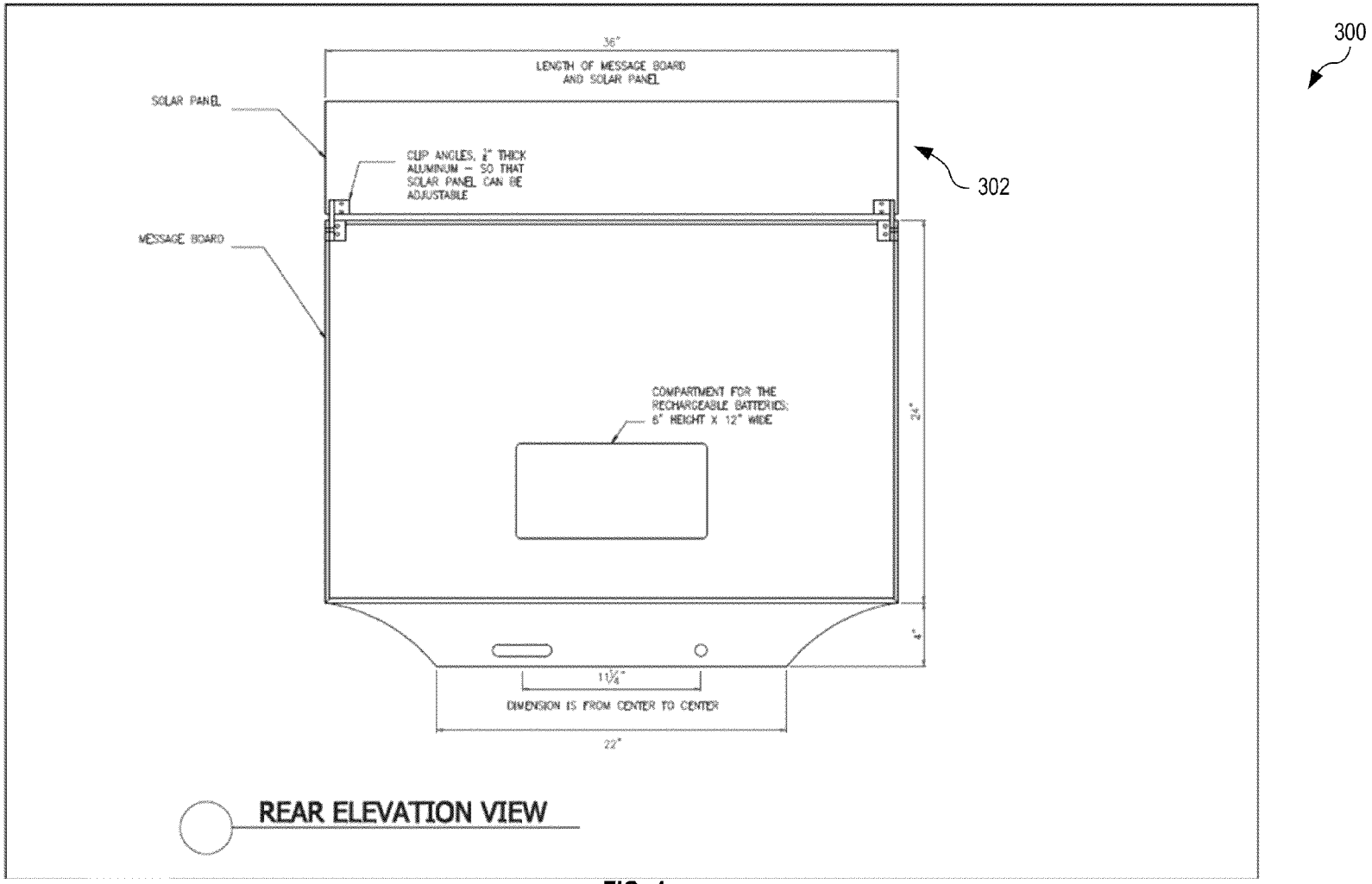
FIG. 4 is a rear elevation of the enhanced barrel mounted traffic message board system of FIG. 3.
Figure 5:
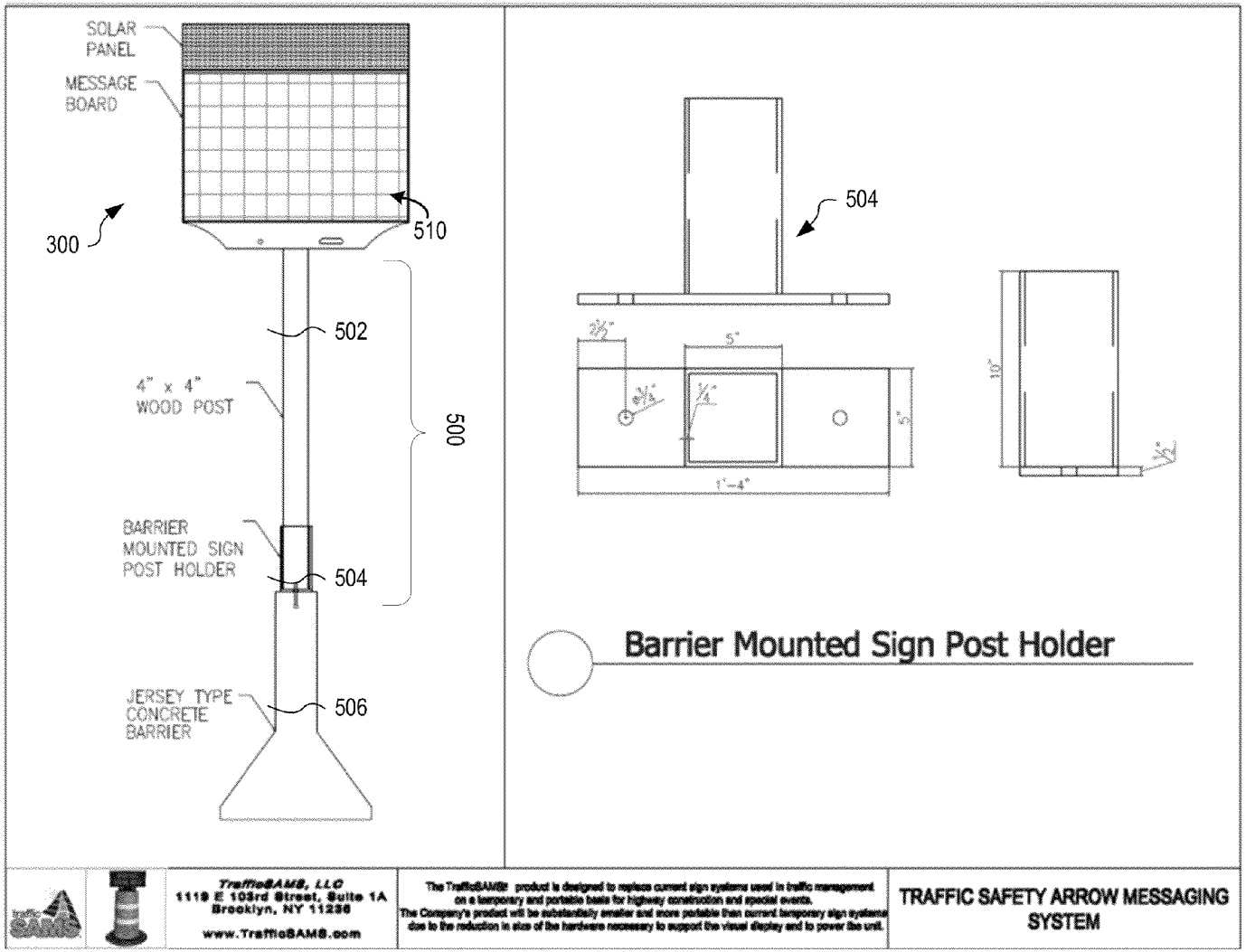
FIG. 5 shows an alternative post based Jersey barrier mounting for the traffic message board system of FIGS. 3 and 4.

FIG. 3 shows a front elevation and a side elevation of a pole mountable traffic message board 300. FIG. 4 shows a rear elevation of the traffic message board 300 of FIG. 3. FIG. 5 shows a post based Jersey barrier mounting 500 for supporting traffic message board 300 of FIGS. 3 and 4. Traffic message board 300 includes a solar panel 302 and is mounted on a post/pole 502 that couples, using an adapter 504, to a Jersey barrier 506. Solar panel 302 is electrically coupled to, and provides power to, a battery 510 located in a housing behind message board 300.

FIGS. 6 and 7 show an outside portion 600 and an inside portion 700 of an exemplary brochure for a barrel mounted traffic message board system. Inside and outside portions 600, 700 contain exemplary information of barrel mounted traffic message board system 100 of FIGS. 1 and 2.

Figure 8:
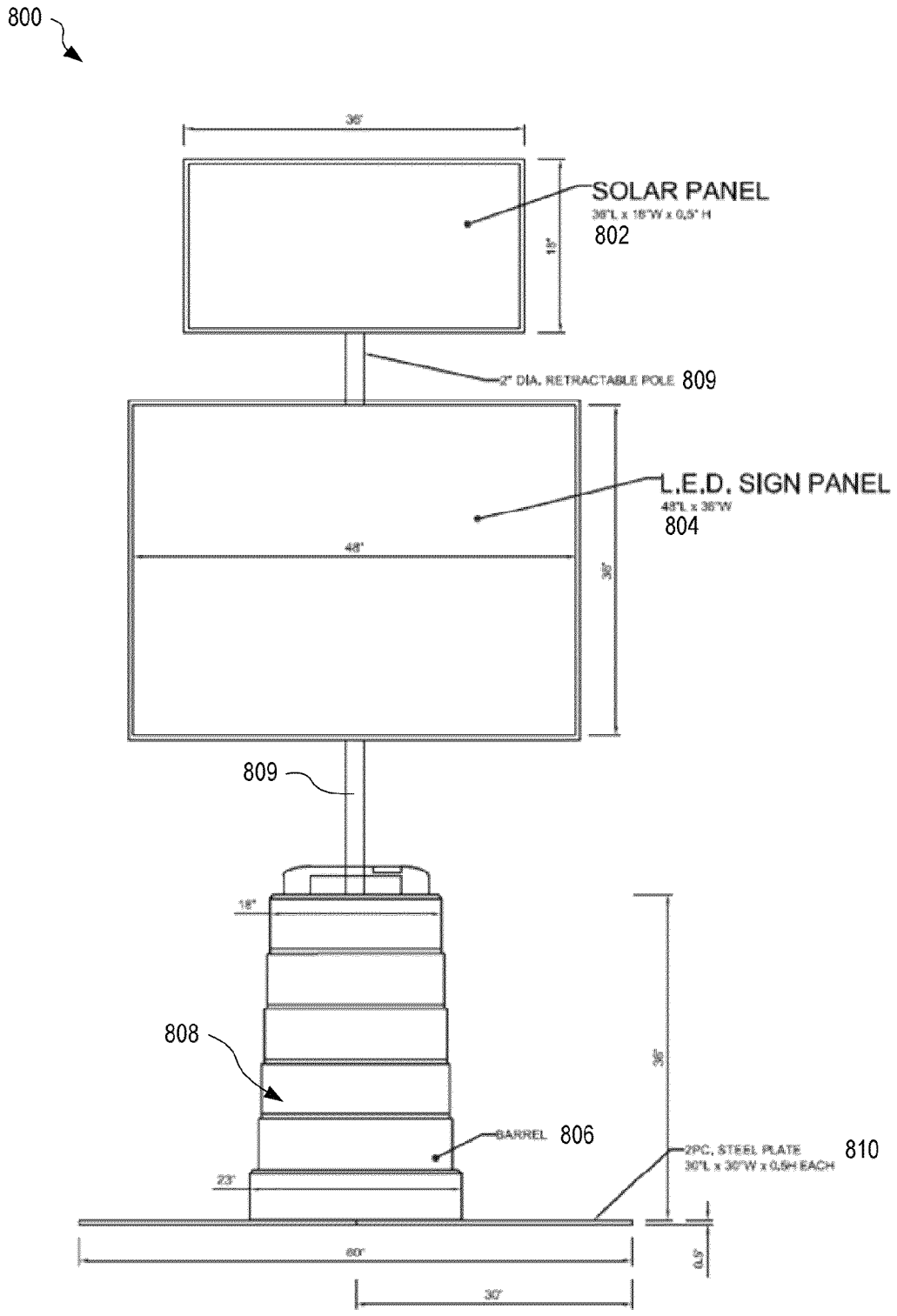
FIGS. 8 and 9 show an exemplary enhanced barrel mounted traffic message board system, in an embodiment.
Figure 9:
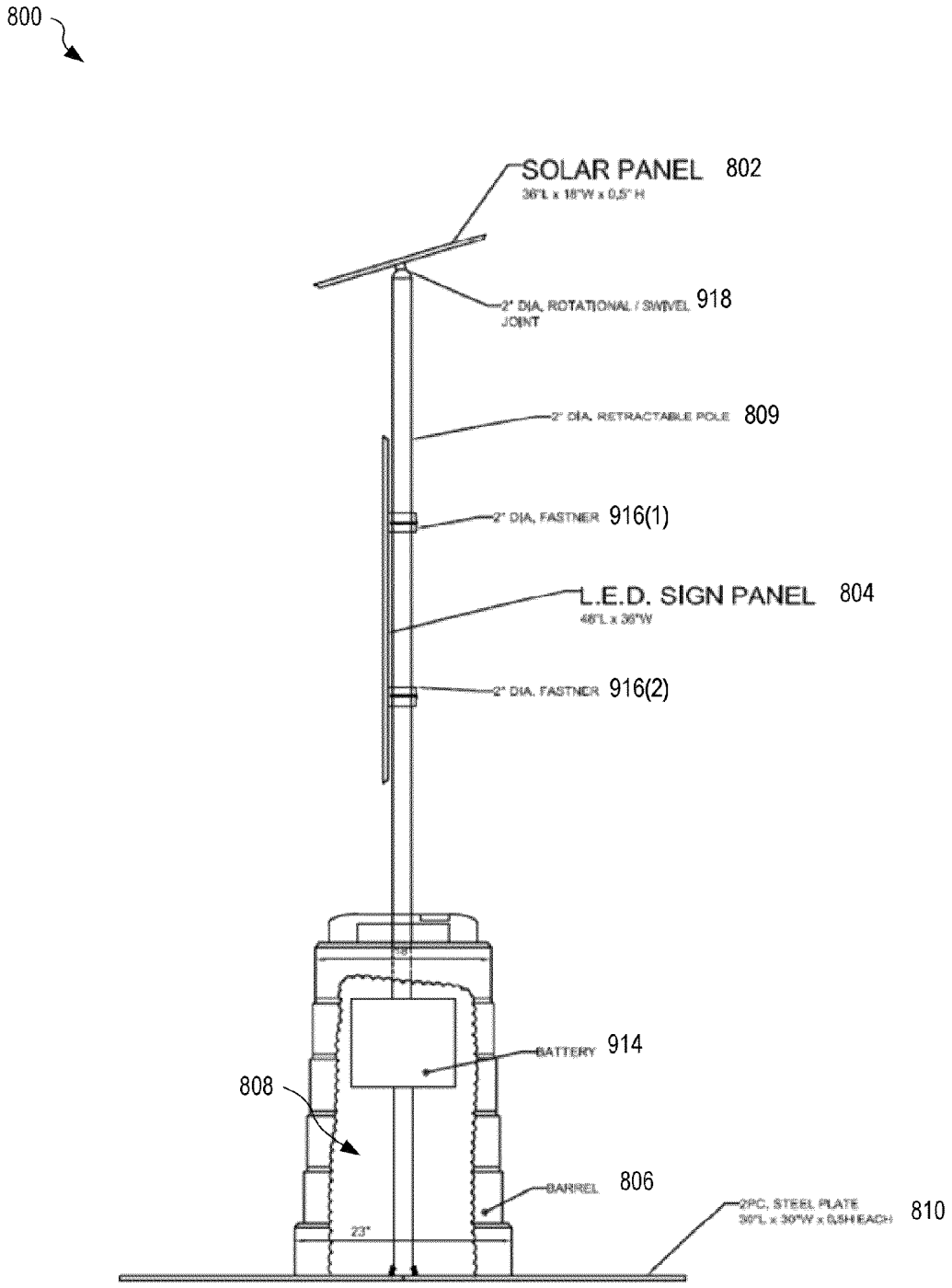

FIG. 8 is a front elevation showing one exemplary enhanced barrel mounted traffic message board 800, in an embodiment. FIG. 9 is a side elevation showing the enhanced barrel mounted traffic message board 800 of FIG. 8. FIGS. 8 and 9 are best viewed together with the following description.

System 800 includes a solar panel 802, a traffic message board 804, a barrel 806, internal structure 808, a pole 809, and a base plate 810. Base plate 810 attaches to internal structure 808 that includes pole 809 such that pole 809 passes substantially vertically through the top of barrel 806. Traffic message board 804 attaches to pole 809 using one or more clips 916 for example. Clips 916 allow height of traffic message board 804 to be adjusted on pole 809. Optionally, pole 809 is a retractable pole that further allows height of traffic message board 804 and solar panel 802 to be adjusted.

Barrel 806 may enclose a rechargeable battery 914 that powers traffic message board 804 and receives power from solar panel 802. Solar panel 802 couples to a rotational swivel joint 918 that allows solar panel 802 to be optimally positioned to capture solar energy.

Further Exemplary Detail

Exemplary components of the enhanced barrel mounted traffic message board systems 100 and 800, and the pole mountable traffic message board 300 include:

LED red and amber modules: 24 pcs 96*128 cm
iron waterproof cabinet: 1 pc
power supply with UL: 4 pcs 5v 40 A/pc
GSM control card: 1 pc
wireless GSM moblie control
on-demand card: 1 pc via usb, remote choose program
1 pc remote and receiver for on-demand card
switch of AC110V and solar energy: 2 pcs
switch of two kinds of control card: 1pc
accessory: CD, USB, DATA CABLE LINE
P10 led message board
pixel pitch: 10 mm
pixel: 96*128 dots
composed of pixel: 1R1A
display size: 96*128*10 cm
cabinet size: 96*128*10 cm
area of full panel: 1.2288 sqm
waterproof cabinet colour: black
power supply: AC110V
solar energy battery: 5v 120A
power: 600w
brightness: 2000 mcd/sqm
Beam Angle: 50~120
packing: wooden case Additional features of barrel mounted traffic message board 100 may include:

Video playback. The traffic message board may display a sequence of video frames.

Still Picture playback. The traffic message board may display a slide show of still pictures.

Color option. The traffic message board may be configured to display color.

Rain sensor. The traffic message board may include a rain sensor, wherein the displayed message is selected based upon the sensed rain.

Temperature sensor. The traffic message board may include a temperature sensor that measures ambient temperature, wherein the displayed message is selected based upon the sensed temperature.

Audio output. The traffic message board may include an audio output (e.g. a speaker). The audio output allows use of the traffic message board in other environments, such as a train station, and other situations such as an emergency where audio instructions may be provided to the public.

Low battery indicator. The traffic message board may include an indicator of low battery level.

Double sided display. The traffic message board may be double sided, wherein information is imparted to traffic passing in both directions.

Jersey barrier mount. As shown in FIG. 5, the traffic message board may mount to a Jersey barrier.

Triton Barrier mount. The traffic message board may include means for mounting to a Triton barrier.

Solar is mounted at top and hinged/pivoted to allow positioning. The traffic message board may include a hinge and/or pivot mechanism that allows the solar panel to be positioned for optimal solar collection.

Selectable play modes. The traffic message board may include multiple display modes that are selectable.

USB interface. The traffic message board may include a USB interface that allows programming using a Personal Computer.

Wi-Fi interface. The traffic message board may include a wireless Wi-Fi interface that allows programming using a Personal Computer.

GPS receiver. The traffic message board may include a GPS receiver that monitors its position such that it may detect when it is moved without authorization (e.g., stolen).

Alarm. The traffic message board may include an alarm to provide warning to nearby traffic and/or workers. For example, the device may sound the alarm if device is moved from a set location (e.g., as determined using the GPS receiver)—even if display is turned off.

A wireless communication interface (e.g., Wi-Fi) that forms an ad-hoc network with other Barrel mounted traffic message boards such that a coordinated display may be presented across multiple units for easier viewing of moving vehicles.

An programming interface. The traffic message board may include an interface to allow a portable device (e.g., a smart phone) to program the display (and may include protection to prevent unwanted programming).

Deactivator. The traffic message board may include a deactivation unit that makes the display unusable if stolen.

Changes may be made in the above methods and systems without departing from the scope hereof. It should thus be noted that the matter contained in the above description or shown in the accompanying drawings should be interpreted as illustrative and not in a limiting sense. The following claims are intended to cover generic and specific features described herein, as well as all statements of the scope of the present method and system, which, as a matter of language, might be said to fall therebetween.

What is claimed is:

1. An enhanced barrel mounted traffic message board system for displaying information to traffic, comprising:

a linear pole, the linear pole having opposing first and second ends that align along a same linear axis;

a traffic message board for displaying the information to the traffic, wherein the traffic message board is adjustably coupled to the first end of the linear pole;

a battery for providing power to the traffic message board;

a solar panel for providing power to the battery, wherein the solar panel is adjustably coupled to the linear pole;

a traffic barrel;

a substantially horizontal base plate attached to the second end of the linear pole; and a ballast disposed within the barrel and coupled to the base plate near the second end of the linear pole to provide support to the linear pole;

wherein the linear pole aligns substantially vertically with respect the horizontal base plate and extends through a top portion of the traffic barrel;

wherein the battery is disposed within the traffic barrel.

2. The system of claim 1, wherein the ballast includes a housing for the battery.

3. The system of claim 1, wherein the pole is retractable in the vertical direction, substantially parallel with the linear axis.

4. A method for displaying traffic information, comprising the steps of:

attaching a bottom portion of a pole to a horizontal base plate such that the pole is substantially vertical with respect to the horizontal base plate;

securing a ballast around the bottom portion of the pole near the horizontal base plate;

affixing a traffic message board and a solar panel to an upper portion of the pole, wherein the traffic message board displays the traffic information;

and encasing a traffic barrel around the bottom portion pole, the ballast, and the base plate, below the traffic message board and the solar panel.

5. The system of claim 1, wherein the ballast and base plate prevent the system from becoming unstable and tipping over in strong wind or when struck by a vehicle.

6. The system of claim 3, wherein a height of the traffic message board relative to the base plate is related to an amount of retraction of the linear pole above the top portion of the traffic barrel.

* * * * *